US005397534A

United States Patent [19]

Beineke

[11] Patent Number: 5,397,534

[45] Date of Patent: Mar. 14, 1995

[54] METHOD FOR CONTROLLING CREVICE CHEMISTRY ON THE SECONDARY SIDE OF A PRESSURIZED WATER REACTOR STEAM GENERATOR

[75] Inventor: Thomas A. Beineke, Windsor, Conn.

[73] Assignee: Combustion Engineering, Inc., Windsor, Conn.

[21] Appl. No.: 135,799

[22] Filed: Oct. 13, 1993

[51] Int. Cl.[6] ..... C23F 11/18

[52] U.S. Cl. ..... 422/14; 422/7; 422/18

[58] Field of Search ..... 422/7, 14, 18

[56] References Cited

PUBLICATIONS

"Selection and Application of Ratio Control Approach", S. G. Sawochka, Nov. 18–20, 1992.

"Cation/Anion Ration Control", M. W. Rootham, Nov. 18–20, 1992 San Diego.

"PWR Secondary Water Chemistry Guidelines–Revision 3", Electric Power Research Institute, May 1993.

*Primary Examiner*—Timothy M. McMahon

*Attorney, Agent, or Firm*—L. James Ristas; John H. Mulholland

[57] ABSTRACT

A method for detecting pH imbalances and/or achieving pH balance in crevices of a pressurized water reactor steam generator. The method comprises obtaining hideout return concentrations of sodium, chloride, calcium and sulfate ions, and silica from the water in the secondary side of the steam generator, the concentrations being expressed as moles per kilogram of water, and determining whether the following conditions exist:

$$\text{eq (anions)} < \text{eq (cations)}, \text{ and} \quad \text{(a)}$$

$$[Na^+] < [Cl^-] + 2[SO_4^{2-}] \quad \text{(b)}$$

the crevice pH being balanced when all the conditions of the determining step are satisfied. The method of the invention preferably further includes determining whether the following conditions also exist:

$$[Cl^-] < [Na^+] \quad \text{(c)}$$

$$[SiO_2] > [Ca^{2+}] + [Mg^{2+}] \quad \text{(d)}$$

$$[Na^+]/[Cl^-] < 1.9. \quad \text{(e)}$$

If and when the above conditions are met, it can be expected that crevice pH will be balanced at a generally neutral level.

16 Claims, 3 Drawing Sheets

METHOD FOR CONTROLLING CREVICE CHEMISTRY ON THE SECONDARY SIDE OF A PRESSURIZED WATER REACTOR STEAM GENERATOR

BACKGROUND OF THE INVENTION

The present invention relates generally to pressurized water reactor steam generators, and more particularly to a method for controlling crevice chemistry on the secondary side of a pressurized water reactor steam generator.

In the steam generator of a pressurized water reactor, it is important to maintain proper secondary side water chemistry to provide for long-term integrity of the steam generator components. Maintenance of proper water chemistry is not necessarily straightforward, because when evaporation occurs on the secondary side of the steam generator, impurities concentrate in regions of restricted flow, designated hereinafter as crevices, resulting in concentrated aqueous solutions which can be corrosive toward steam-generator materials of construction. These impurities can be introduced as a result of weld repair, plant modification, component replacement, leakage in the condenser, or makeup water contamination. These concentrated impurity solutions are known to be corrosive even though the specific corrosive specie has not been identified. It is known, however, that acidic or alkaline conditions, typically produced in these concentrated solutions, accelerate corrosion. For this reason, it is beneficial to maintain neutral (i.e. neither acidic nor alkaline) conditions for these concentrated solutions of impurities. In this way, the rate of corrosion of various components such as those made of Alloy 600 can be minimized.

To minimize corrosion and thereby provide for long-term use of steam generators in pressurized water reactors, computer programs have been developed to assist in maintaining acceptable water chemistry standards. Emphasis has been placed on "ratio control," which is a procedure through which an effort is made to maintain a constant, neutral, ratio of cations to anions on the secondary side of the steam generator.

As traditionally practiced, "ratio control" involves the measurement, recording, and adjustment of one of the following concentration ratios for the bulk water chemistry during operation of the steam generator:

$$[Na^+]/[Cl^-] \sim 0.5$$

$$[Na^+]/\{0.7[Cl^-]+2[SO_4^{2-}]\} \sim 1,$$

in which concentrations are expressed in terms of moles or micromoles per kilogram of water. Details of this procedure are provided in *PWR Secondary Water Chemistry Guidelines—Revision* 3, TR - 102134, Electric Power Research Institute, May 1993, Appendix D (EPRI Guidelines).

It is known that there are differences between cation-to-anion ratios in the bulk water of a steam generator, and ratios in the crevices. More specifically, the sodium-to-chloride ratio in the bulk water is likely to be lower than the sodium-to-chloride ratio deep within crevices within the steam generator, because sodium hides out more effectively than chloride. A practical way to allow for these differing hideout efficiencies is to maintain a bulk-water molar ratio of sodium to chloride less than 1. (In the absence of other information, the guidelines document, TR-102134, suggests beginning with a ratio of 0.5.) The intent is that such a bulk-water ratio should maintain the molar ratio within crevices near 1. The thinking has been that, within crevices, a ratio of sodium to chloride near 1 would keep the crevice pH near neutral.

A term which distinguishes the chemical properties deep within crevices, from bulk-water properties, and which will be used in this document, is "crevice chemistry." As indicated in the EPRI Guidelines, the crevice chemistry on the secondary side of a steam generator can be predicted or estimated based upon "hideout return data," which is a measurement of the secondary-water dissolved impurity concentrations which result from plant shut-down. Hideout return data can be collected during temporary plant shut-down and can then be used as a basis for modifying bulk water chemistry during subsequent periods of operation.

It is known that the impurities present in steam-generator bulk water become increasingly concentrated in steam generator crevices over time. To predict these concentrations, the PWR industry routinely has used the computer code, MULTEQ, which was developed for the purpose of simulating these changes in concentration. As indicated in the EPRI Guidelines, MULTEQ is an interactive FORTRAN computer program which predicts changes in pH and solution concentration, based upon initial concentration data, as the impurities in the water become increasingly concentrated as a result of evaporation. The program takes into account equilibrium relations, including particular combinations of components, precipitation reactions, and volatilization. Based upon the characteristics of a particular system, MULTEQ calculates concentration variations in the liquid phase as boiling proceeds.

MULTEQ has three program options, which correspond to three different ways in which the solution may be concentrated. The first and second program options assume that a closed (static) system is involved, in which the ratio of the mass of water in the liquid phase is varied while the total mass of the stream remains constant. The first option is recommended for use in modeling tube-to-tube support plate crevices. In this type of system, the precipitates remain in equilibrium with the liquid and vapor phases. The second program option generally is used to model tubesheet crevices or very restricted tube support plate crevices. In this second type of system, precipitates are removed from the system as they form. As a result, the precipitates have no subsequent effect on liquid or vapor phase chemistry. The third option is useful to model the accumulation of chemicals in sludge piles or scales. In accordance with this system, the mass of liquid water flowing into the system is equated to the mass of water vapor flowing out of the system.

Typically, the MULTEQ computer system is used in the following manner. Concentration data is input for concentrations of sodium, calcium, chloride, silicate, sulfate, and, optionally, additional parameters, such as magnesium. Based upon the input concentrations, the MULTEQ code will predict increases in solution concentrations to a predetermined end point. The resulting calculations can be expressed in terms of a plot of pH (at the operating temperature) versus ionic strength. The drawback of the MULTEQ system is that MULTEQ will simulate increases in concentration only after ion concentrations have been input. In order to obtain predictive output, it is necessary to make adjustments to the input concentrations, such as the ratio of sodium to chloride, and then run the computer program and subsequently observe the result. Thus, this system does not provide for an up-front indication of specific changes to be made in sodium and/or chloride concentrations in order to arrive at a desired result.

SUMMARY OF THE INVENTION

An object of the invention is to provide a method for ensuring the long-term integrity of a steam generator in a pressurized water reactor by minimizing corrosion of the steam generator components.

Another object of the invention is to provide an efficient method for controlling water chemistry on the secondary side of a steam generator in a pressurized water reactor.

Another object of the invention is to provide a more reliable method for controlling water chemistry in a steam generator by detecting whether pH is in balance in the steam generator crevices.

Yet another object of the invention is to provide a method for predicting in advance what adjustments are needed in water chemistry in order to achieve proper pH in the crevices of a steam generator.

Other objects will be in part obvious and in part pointed out in more detail hereinafter.

One preferred embodiment of the invention is a method for detecting pH imbalances (or confirming pH balance) in crevices of a pressurized water reactor steam generator. The method comprises obtaining hideout return concentrations of sodium, chloride, calcium and sulfate ions, and silica on the secondary side of the steam generator, the concentrations being expressed as molality, i.e., moles of impurity per kilogram of water, and determining whether the following conditions exist:

$$\text{equivalents (anions)} \leqq \text{equivalents (cations), and} \quad (a)$$

$$[Na^+] \leqq [Cl^-] + 2[SO_4^{2-}]. \quad (b)$$

Square brackets around a chemical symbol denote concentration in molality; whereas equivalents will be indicated below, as "eq". In accordance with the present invention, the crevice pH is balanced when all of the conditions of the determining step are satisfied.

To obtain even more favorable results, the step of determining further includes determining whether the following condition exists:

$$[Cl^-] \leqq [Na^+]. \quad (c)$$

In a particularly preferred embodiment, the method further includes obtaining the hideout return concentration of magnesium, and the step of determining further includes determining whether the following conditions exist:

$$Mg^{2+} \text{ is present and} \quad (d)$$

$$[SiO_2] > [Ca^{2+}] + [Mg^{2+}]. \quad (e)$$

In another preferred form of the invention, the method further includes the step of determining whether the following condition exists:

$$[Na^+]/[Cl^-] \leqq 1.9 \quad (f)$$

The method of the invention is based upon "prompt" hideout return data taken within about four hours or less after shut-down, before the water temperature has fallen, and/or partial or full cooldown hideout return data taken as or after the water temperature has been reduced to about 300°–350° F. The method of the invention also can include the step of obtaining hideout return concentrations of other cations and/or anions, such as potassium, provided that the moles of potassium are reckoned as sodium, that is added to the moles of sodium, for the purpose of this calculation. (In its present form, i.e., version 2.1 with Species File 2.75, MULTEQ is incapable of handling potassium properly.) In determining condition (a), silicon-containing cations and anions are ignored.

Another embodiment of the invention is a method for obtaining a substantially neutral pH in crevices of a pressurized water reactor steam generator. The method comprises obtaining hideout return concentrations of sodium, chloride, calcium and sulfate ions and silica in the water on the secondary side of the steam generator, and adjusting the concentrations of sodium and chloride ions to the extent necessary to reach the following hideout return concentrations:

$$\text{eq (anions)} \leqq \text{eq (cations), and} \quad (a)$$

$$[Na^+] \leqq [Cl^-] + 2[SO_4^{2-}]. \quad (b)$$

The invention accordingly comprises the several steps and the relation of one or more such steps with respect to each of the others, and the relation of elements exemplified in the following detailed disclosure.

DETAILED DESCRIPTION OF THE INVENTION

In the conventional method for correcting imbalances in the water chemistry on the secondary side of a pressurized water reactor steam generator, described above, the recommendation has been made to adjust sodium and/or chloride concentrations such that $[Na^+]/[Cl^-]=0.5$ in the bulk water. It has been thought that if this concentration ratio were achieved, the approximate ratio of sodium and chloride concentrations in the crevices would be about 1.0. Furthermore, it has been recommended that hideout return data be used as a measure of how close the crevice ratio is to 1.0 and to make adjustments accordingly.

The present invention is an improvement over the use of the rather arbitrary sodium-to-chloride molar ratio of 1.0 for hideout return (i.e. crevice chemistry) data. The present invention recognizes that crevice chemistry depends upon much more than sodium and chloride concentrations. In place of the hideout-return molar ratio of 1.0 indicated above, the present invention employs a decision logic mechanism which includes two or more steps.

The basis for the present invention is the discovery that the results of multiple hideout return studies can be described with respect to only six different pH-ionic concentration curves. The development of these six curves is based upon 60 sets of return hideout data from 32 shut-downs in 10 different pressurized water reactors and the running of MULTEQ with the option of precipitates being retained. A set of rules was established in order to provide instructions as to how to adjust water chemistry in order to ensure that the pH in the crevices is close to neutral, thereby minimizing intergranular attack (IGA) and stress corrosion cracking (SCC) of steam generator tubing, such as mill annealed Alloy 600 tubing. To achieve proper pH, one of the six curves is most preferred, while two of the other curves also may be considered acceptable. All six curves, shown in FIGS. 1A–1F, are based on calculations of pH with precipitates being retained. This invention focuses on the MULTEQ option of retaining precipitates since, as will be shown in the following, control over the option of precipitates removed, is based on an understanding of control with precipitates retained. Furthermore, unless the pH is under control based on the precipitates retained option, there is no way to control the pH under the option of precipitates removed.

Curves 1–6 of the present invention are based upon concentration measurements of sodium, chloride, calcium, magnesium and sulfate ions, as well as silica, which is present in the water on the secondary side of a steam generator.

Figure 1A:
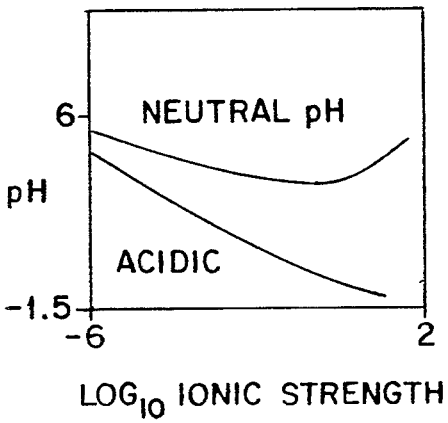
FIGS. 1A–1H are concentration curves for the chemistry of secondary side steam generator water, expressed in terms of pH versus ionic strength, with FIGS. 1A–1F based on calculations with precipitates retained, and FIGS. 1G–1H based on calculations with precipitates removed.

Curve 1, shown in FIG. 1A, represents an uncontrolled shift toward acidic pH. This curve results when the number of equivalents of anions exceeds the number of equivalents of cations, with silicon-containing materials being counted as neither anions nor cations.

Figure 1B:
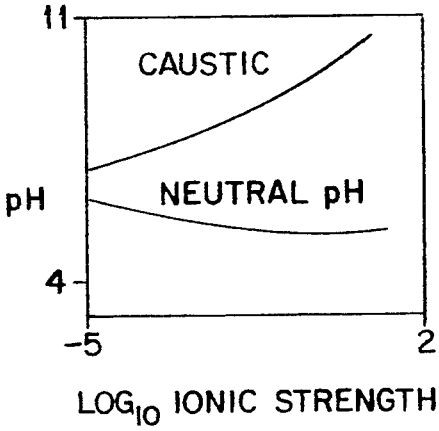

Curve 2, shown in FIG. 1B, represents an uncontrolled shift toward caustic pH. A primary requirement for this curve is that the number of equivalents of cations exceeds the number of equivalents of anions. Furthermore, it is necessary that the molar concentration of sodium exceeds twice the molar concentration of silica. This latter requirement is due to the formation of the precipitate $Na_2SiO_3$ in which there is a two-to-one mole ration of sodium to silicon.

Figure 1C:
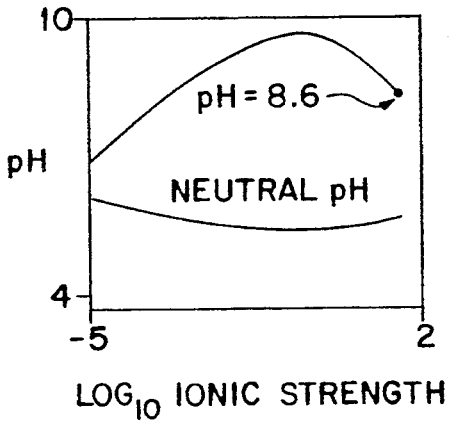

Curve 3, shown in FIG. 1C, represents the situation in which the conditions for curve 2 do not apply, and, furthermore, $[Na^+]>[Cl^-]+2[SO_4^-]$. This curve is undesirable because it reaches a peak pH of 9, which is too high. At the operating temperature of a PWR steam generator, neutral pH of the secondary side water is about 5.

Figure 1D:
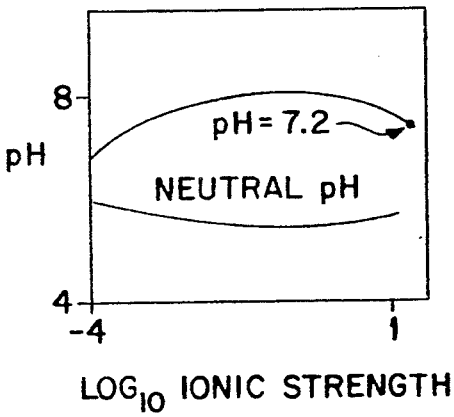

Curve 4, shown in FIG. 1D, appears to be a special case of curve 6 and is reached when there is both a low quantity of silica and magnesium is present. It is expected that curve 4 will result when silica is present in a concentration of less than the sum of the concentration of calcium and magnesium. While curve 4 is not unacceptable, it is less desirable than curve 6 because the pH is above neutral for substantially all ionic concentrations.

Figure 1E:
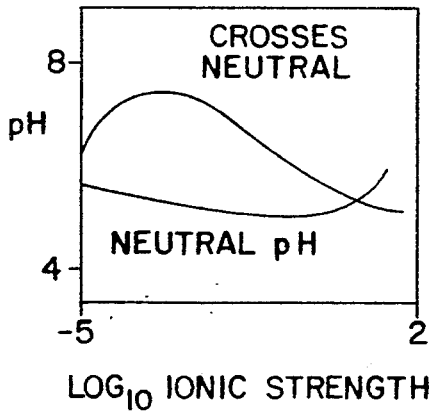

Curve 5, shown in FIG. 1E, results when the molar concentration of chloride exceeds the molar concentration of sodium. Generally, in accordance with this curve, the $pH_T$(pH at operating temperature) will cross from being alkaline to being more acidic at an ionic strength of about 10 molal. While concentrations which fall along this curve are acceptable, they are not as favorable as those of curve 6 because the solution of curve 5 is not buffered.

Figure 1F:
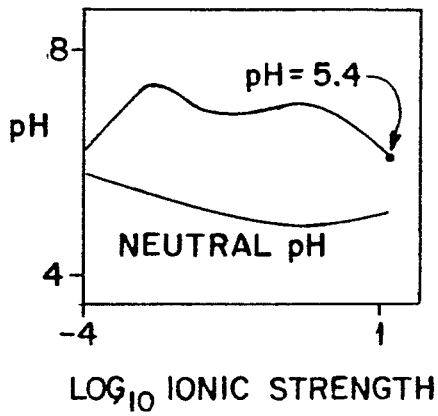

Curve 6, shown in FIG. 1F, represents the most preferred water chemistry. Curve 6 results when the conditions of curves 1–4 are not met and, in addition, when the molar concentration of sodium exceeds the molar concentration of chloride. This curve is likely both with and without magnesium provided that the silica concentration exceeds the sum of the calcium and magnesium. The important advantages of this curve are that it has a neutral final $pH_T$, and that this final $pH_T$ is well buffered by the precipitates which form. The buffering renders this curve more desirable than curve 5.

Figure 2:
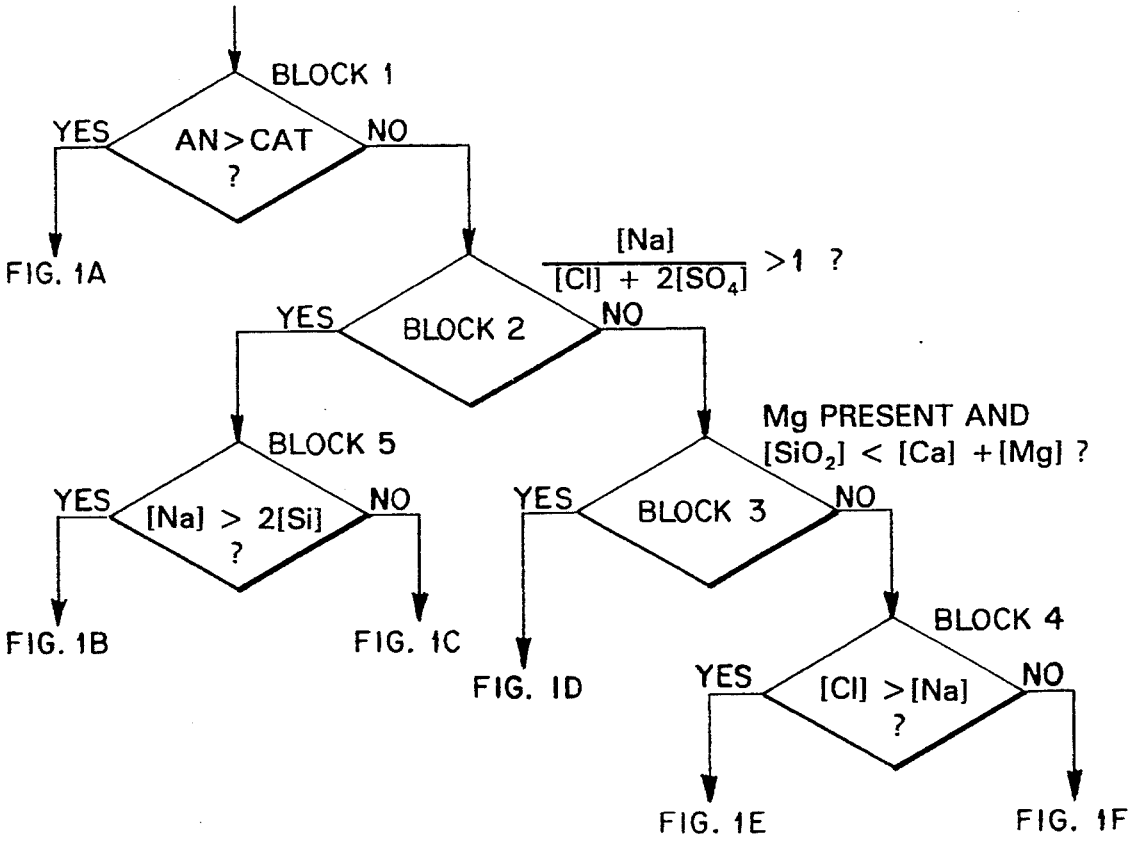
FIG. 2 is flow chart for use in correcting water chemistry imbalances or verifying water chemistry balances in accordance with the present invention.

Restated, as shown in FIG. 2 (applicable for the MULTEQ option of retained precipitates), the following conditions should apply in order to obtain concentrations corresponding to curve 6:

$$eq(cations) \geqq eq(anions)$$

$$[Cl^-]+2[SO_4^{2-}] \geqq [Na^+]$$

$$[SiO_2]>[Ca^{2+}]+[Mg^{2+}]$$

$$[Cl^-] \leqq [Na^+].$$

If these conditions apply, the condition of $[Na^+]<2[SiO_2]$ will be immaterial. This latter condition is important only if $[Cl^-]+2[SO_4^{2-}]<[Na^+]$.

When impurities are present in the bulk water, they form precipitates such as magnesium silicates, calcium silicate, silicon dioxide, calcium sulfate, and, during the final stages of concentration, sodium sulfate and sodium chloride. The precipitates therefore remove some impurities from the bulk water. It is the ratio of remaining dissolved ions, not the ratio observed under conditions of hideout return, which determines final crevice pH. The precipitates which are in contact with the concentrated solution exercise a buffering action over the fluid pH. This buffering provides considerable stability to the chemical system, and as indicated above, there is now way, under the option of precipitates being removed, for the fluid pH to be close to neutral if the conditions described for precipitates retained have not first been met. If a finer degree of control over pH is desired, it may be useful, although not mandatory, to look at pH curves based on precipitates being removed, such as the curves of FIGS. 1G–1H, as well as curves based on precipitates being retained.

Figure 1G:
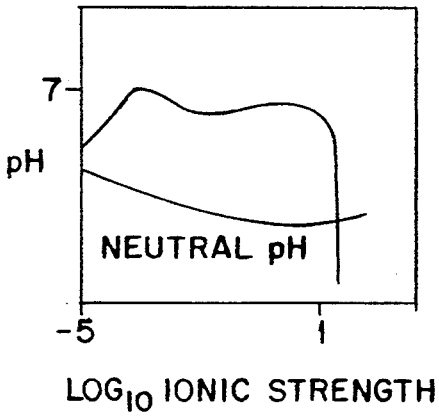
Figure 1H:
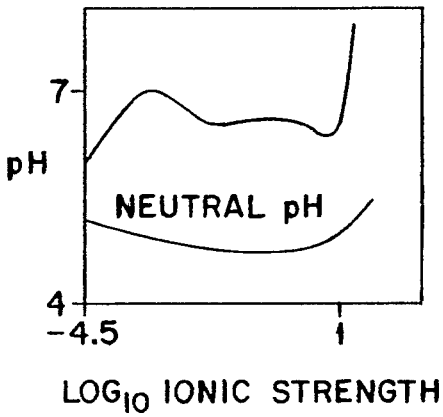

While not required, additional conditions can be considered, which are based on two additional curves, representing systems with precipitates being removed. As indicated above, if the calculation is made under the option of precipitates removed, the resulting chemical system is much less stable, there being no buffering action from the precipitates. In view of the fact that there may not be ideal mixing of components within crevice solutions, it may be advantageous to consider the calculation under this less stable mode. In general, Curve 6 from the "precipitates retained" option, becomes either curve **6*a*, shown in FIG. 1G, or 6*b*, shown in FIG. 1H. Curve 6*a* moves toward an acidic concentration when precipitates are removed. Curve 6*b*** moves toward highly caustic conditions when precipitates are removed.

Figure 3:
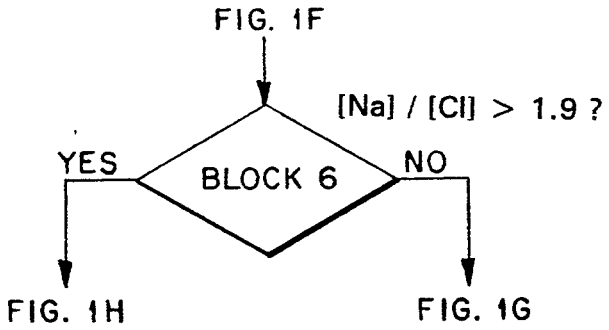
FIG. 3 is a supplemental flow chart for use in correcting water chemistry imbalances or verifying water chemistry balances in accordance with the present invention.

A flow chart for distinguishing between curves **6*a* and 6*b* is shown in FIG. 3, which is applicable to the MULTEQ option of having precipitates removed. In accordance with this chart, curve 6b results if $[Na^+]/[Cl^-]>1.9$. Curve 6a results if $[Na^+]/[Cl^-]<1.9$. In general, Alloy 600 is more susceptible to caustic conditions than to acidic (though specific metallurgical conditions may render the material more susceptible to acidic attack). For this reason, curve 6a** may be preferable.

The concentrations upon which the above calculations are based can be "prompt return data", i.e., concentration data collected at operating temperature and zero power (typically within about four hours after shut down), or "cooldown data", which is taken during or after the steam generator water has cooled to an average temperature between about 300°-350° F.

Concentration data to be used in accordance with this invention preferably is for cumulative concentrations. Such concentrations can be obtained by measuring instantaneous concentrations at spaced time intervals after shut down or during cooldown, and then performing an integration in a conventionally known manner, as described in the EPRI Guidelines.

Many of the ions for which concentration measurements are made have inverse solubility coefficients, i.e. they tend to redissolve in water as the water is cooled. Therefore, if data is based upon concentration measurements taken at cooler temperatures, it is likely that the concentrations of ions having inverse solubility coefficients will be higher than concentrations taken at higher temperatures.

The preferred method of the present invention is practiced in the following manner. Concentration data for sodium, chloride, calcium, sulfate, magnesium, and silica is obtained, and used in the flow chart shown in FIG. 2. In comparing equivalents of cations to equivalents of anions, in block 1, silica is excluded. If it is found that eq (anions)<eq (cations), the analysis proceeds to block 2. If eq (anions)>eq (cations), the conclusion is made that the pH is represented by curve 1, and it is therefore known that the impurity concentrations should be modified in order that eq (anions)<eq (cations). A concentration change, in this case a reduction in chloride and/or sulfate, is then proposed which results in a "no" decision in block 1, and then analysis proceeds to block 2 using the modified concentration data.

In block 2, if a "no" decision is reached, the analysis proceeds to block 3. On the other hand, if a "yes" decision is reached in block 2, further concentration modifications are proposed in order to result in "no" decisions in both of blocks 2 and 1, and analysis proceeds to block 3 on the basis of the proposed revised concentrations.

In block 3, if a "no" decision is reached, the analysis proceeds to block 4. If block 3 results in a "yes" decision, concentration modifications are proposed which will result in "no" decisions in blocks 3, 2 and 1, and analysis proceeds to block 4 on the basis of the proposed modifications.

In block 4, if a "yes" decision is reached, modified concentrations are proposed which would result in a "no" decision. When a "no" decision is reached, the concentrations upon which the decision is based are determined to be suitable for providing a generally neutral pH in steam generator crevices. If the concentrations are the same concentrations as were initially used in block 1, then no modifications to water chemistry are required. On the other hand, if the concentrations which resulted in a "no" decision in block 4 are different than the initial concentrations, then it is determined that the water chemistry should be altered in order to result in the concentrations which were found to result in a "no" decision in each of blocks 1-4.

The analysis of block 5 can be performed after reaching a "yes" decision in block 2 in order to determine whether the concentrations correspond to the pH of curve 2 or the pH of curve 3, both of which represent considerable, caustic conditions.

If further analysis is desired after finding a concentration which results in a "no" decision in each of blocks 1-4, the flow chart of FIG. 3 is employed. If $[Na^+]/[Cl^-]<1.9$, curve 6a results, which may be preferable for most metallurgical conditions of Alloy 600. If a "yes" decision is reached in block 6, a concentration modification may be made such that $[Na^+]/[Cl^-]<1.9$.

If these concentrations are different than the initial concentrations used in block 6, then it is known that modifications should be made in the bulk water chemistry to meet the proposed modified concentrations. On the other hand, if the initial concentration data is the same as that which resulted in a "yes" decision in block 6, no changes in water chemistry over what was found in the analysis of blocks 1-6 are required.

In an alternative, shortened form, the method of the present invention can be limited to the logic of blocks 1 and 2. This is possible in view of the discovery that concentrations corresponding to any of curves 4-6 are acceptable, although, as indicated above, curve 6 is most preferred.

Another embodiment of the invention involves the use of only logic blocks 1, 2 and 4 of FIG. 2. This procedure can be followed when it is already known that a particular system has no magnesium.

Having generally described the invention, the following example is included for purposes of illustration so that the invention may be more readily understood and is in no way intended to limit the scope of the invention, unless otherwise specifically indicated.

EXAMPLE

Appendix D of the EPRI Guidelines includes MULTEQ calculations for an unidentified "Plant I" for which it was concluded that to correct an unacceptably high sodium-to-chloride ratio, there was less risk of uncontrolled swings in pH if chloride were added than if sodium were removed. The data for Plant I is analyzed below in terms of the method of the present invention, and a different conclusion is reached. Rather than adding chloride, the present invention shows that sodium should be removed, and this removal should be a smaller quantity than the 50% reduction discussed in the EPRI Guidelines.

Concentration data for Plant I is shown in Table 1. Applying the decision tree of FIG. 2, the total equivalents of cations equals $0.1305+2(0.0250)=0.1805$. The total equivalents of anions equals $0.0564+2(0.0312)=0.1188$. The total equivalents of anions is less than the total equivalents of cations, and therefore, the first decision follows the "no" branch. The second test is whether the equivalents of sodium divided by the sum of the equivalents of chloride plus sulfate exceeds 1. In this case, the equivalents of chloride plus sulfate is the same as the equivalents of anions, e.g. 0.1188. The ratio therefore is $0.1305/0.1188=1.10$. Thus, the decision follows the "yes" branch. The next test is whether the moles of sodium exceeds twice the number of moles of silica. In this case, 0.1305 moles of sodium is less than 2(0.1664) moles of silica, and the decision follows the "no" branch to curve 3, which, according to FIG. 1(*c*), has a caustic final $pH_T$ of 8.6. This prediction is in agreement with the results of MULTEQ shown in EPRI Guidelines, Appendix D, in which the pH is indicated to be 8.58.

It is noted that one of the adjustments which is considered in the EPRI Guidelines, i.e. reducing sodium by half, to 1.5 grams, would put this system out of control. If the sodium concentration were reduced, the total equivalents of anions would remain unchanged at 0.1188, while the total equivalents of cations would be reduced to 0.1152. As a result, the decision in block 1 would follow the "yes" branch to curve 1, the acidic curve. This is consistent with the results reported in the EPRI Guidelines, Appendix D, reference 7, in which a reduction of sodium to one half its original value resulted in an acidic crevice having a pH of 1.59.

An alternative solution proposed in the EPRI Guidelines of doubling the chloride leaves the equivalents of cations unchanged at 0.1805, but increases the equivalents of anions to 0.1752, resulting in a ratio of 1.03. This decision therefore follows the "no" branch from the first logic block. Furthermore, the equivalent ratio of sodium to the sum of sulfate and chloride is $0.1305/(0.0564)+2(0.0312))=0.74$, resulting in a "no" decision in block 2. There being no magnesium in this example, decision block 3 s bypassed, and the logic proceeds directly to block 4. The decision in block 4 also follows the "no" branch in comparing the concentrations of sodium and chloride, the sodium concentration exceeds the chloride concentration, resulting in curve 6. This curve has a final $pH_T$ of 5.4, which is in exact agreement with the MULTEQ calculation of Appendix D. Thus, this is one possible way of maintaining neutral chemistry.

When calculations are performed based upon precipitates removed, the logic blocks shown in FIG. 2 guarantee that a reduction in sodium will result in an acidic pH once precipitates are removed, just as was the case when precipitates are retained. For the situation in which chloride is doubled, curve 6*a* is expected to result when precipitates are removed, because the equivalent ratio of sodium to chloride is 1.15, which is less than 1.9.

The method of the present invention carries the analysis a step further than the EPRI Guidelines, as it can be used to calculate upper and lower limits for chloride addition and sodium removal, respectively. The desired neutral curve can be obtained if sodium were reduced to an amount which would reduce the equivalent ratio of sodium to chloride plus sulfate to less than 1.0 without reducing the cation-to-anion below 1.0. Using the values in Table 1, it is apparent that this can be achieved in the following way:

1). The equivalent ratio of sodium to the sum of chloride plus sulfate must be less than 1, $$eq(Na^+)/\{eq(Cl^-)+eq(SO_4^{2-})\}<1$$

i.e., eq(Na) must be less than $0.0564+2(0.0312)=0.1188$ or 2.7 grams, and

2). Sodium must not be reduced so much that the equivalents of cations falls below the equivalents of anions (since this would force the crevice pH to follow the acidic curve 1).

$$\{eq(Na^+)+eq(Ca^{2+})\}>\{eq(Cl^-)+eq(SO_4^{2-})\}$$

In this case $eq(Cl^-)+eq(SO_4^{2-})=0.1188$ and $eq(Ca^{2+})=0.0500$. Hence $eq(Na^+)$ must not be less than $0.1188-2(0.0250)=0.0688$. Converted to grams, the lower limit for sodium is 1.6 grams.

Another potential limit is that sodium should not be reduced to a point such that the number of equivalents of sodium are less than the number of equivalents of chloride (the curve 5 criterion). In the current example, if the equivalents of sodium were to be reduced to less than the equivalents of chloride, i.e. 0.0564, the total cations would be less than the total anions. This latter test is immaterial in this particular case. In general both tests should be applied and the lower sodium limit set at the larger of the two criteria.

Hence for Plant I, the target would be to reduce the sodium in the hideout return from its present value of 3.0 grams to somewhere in the range of 1.6 to 2.7 grams, instead of increasing chloride concentrations as was suggested in the EPRI report. This would represent a reduction in operating bulk-water sodium of between 10% and 47%.

As indicated by this example, the decision trees will correctly predict the most effective way to correct an imbalance of sodium and chloride, and more generally, an imbalance of cations and anions.

TABLE 1

Hideout Return Results for Plant I

| Species | Grams | Moles i.e. the number of grams divided by molecular weight | Moles when Sodium reduced by half | Moles when Chloride doubled |
|---|---|---|---|---|
| Na | 3.0 | 0.1305 | 0.0652 | 0.1305 |
| Cl | 2.0 | 0.0564 | 0.0564 | 0.1128 |
| Ca | 1.0 | 0.0250 | 0.0250 | 0.0250 |
| $SiO_2$ | 10 | 0.1664 | 0.1664 | 0.1664 |
| $SO_4$ | 3.0 | 0.0312 | 0.0312 | 0.0312 |

What is claimed is:

1. A method for detecting whether pH is in balance in crevices of a pressurized water reactor steam generator, comprising:

obtaining hideout return concentrations of sodium, chloride, calcium and sulfate ions, and silica, from water in the secondary side of the steam generator, the concentrations being expressed in molality, and determining whether the following conditions exist:

$$eq\ (anions)<eq\ (cations),\ \text{and} \quad (a)$$

$$[Na^+]<[Cl^-]+2[SO_4^{2-}], \quad (b)$$

the crevice pH being balanced when all of the conditions of the determining step are satisfied.

2. A method according to claim 1, wherein the step of determining further includes determining whether the following condition exists:

$$[Cl^-]<[Na^+]. \quad (c)$$

3. A method according to claim 2, wherein the step of obtaining hideout return concentrations further includes obtaining the hideout return concentration of magnesium and the step of determining further includes determining whether the following condition exists:

$$[SiO_2]>[Ca^{2+}]+[Mg^{2+}]. \quad (d)$$

4. A method according to claim 1, wherein the hideout return concentrations constitute prompt hideout return data taken about four hours or less after shutdown.

5. A method according to claim 1, wherein the hideout return concentrations constitute full cooldown hideout return data taken as the water temperature is reduced to about 300–350° F.

6. A method according to claim 1, wherein the step of obtaining hideout return concentrations further includes obtaining the hideout return concentration of potassium and considering the moles of potassium to be moles of sodium in equation (b).

7. A method according to claim 1, wherein in (a), silicon-containing cations and anions are ignored.

8. A method according to claim 3, wherein the step of determining further includes determining whether the following condition exists:

$$[Na^+]/[Cl^-]<1.9. \quad (e)$$

9. A method for achieving a substantially neutral pH in crevices of a pressurized water reactor steam generator, comprising:

obtaining hideout return concentrations of sodium, chloride, calcium and sulfate ions, and silica in the water on the secondary side of the steam generator, and adjusting the concentrations of sodium and chloride ions to the extent necessary to reach the following hideout return concentrations:

$$\text{eq (anions)}<\text{eq (cations), and} \quad (a)$$

$$[Na^+]<[Cl^-]+2[SO_4^{2-}]. \quad (b)$$

10. A method according to claim 9, wherein the step of adjusting further includes adjusting the concentrations of sodium and chloride to the extent necessary to reach the following additional hideout return concentration:

$$[Cl^-]<[Na^+]. \quad (c)$$

11. A method according to claim 9, wherein the step of adjusting, further includes adjusting the concentration of silica to the extent necessary to reach the following additional hideout return concentration:

$$[SiO_2]>[Ca^{2+}]+[Mg^{2+}]. \quad (d)$$

12. A method according to claim 9, wherein the hideout return concentrations constitute prompt hideout return data taken about four hours or less after shutdown.

13. A method according to claim 9, wherein the hideout return concentrations constitute full cooldown hideout return data.

14. A method according to claim 9, wherein the step of obtaining hideout return concentrations further includes obtaining the hideout return concentration of potassium, and considering that the moles of potassium to be moles of sodium in equation (b).

15. A method according to claim 9, wherein in (a), silicon-containing cations and anions are ignored.

16. A method according to claim 11, wherein the step of adjusting further includes determining whether the following condition exists:

$$[Na^+]/[Cl^-]<1.9. \quad (e)$$

* * * * *